United States Patent [19]

Lyons

[11] 4,337,875

[45] Jul. 6, 1982

[54] OVERFLOW AND VENT CAP FOR A CONTAINER

[75] Inventor: Dale E. Lyons, Belvidere, Ill.

[73] Assignee: Atwood Vacuum Machine Company, Rockford, Ill.

[21] Appl. No.: 243,068

[22] Filed: Mar. 12, 1981

[51] Int. Cl.[3] ..... B65D 51/16

[52] U.S. Cl. ..... 220/368; 220/366; 220/374

[58] Field of Search ..... 220/366, 367, 368, 374; 215/307

[56] References Cited

U.S. PATENT DOCUMENTS

| | | | |
|---|---|---|---|
| 3,385,467 | 5/1968 | Lindenberg | 220/374 |
| 3,422,982 | 1/1969 | Terwoerds et al. | 220/366 |
| 4,094,437 | 6/1978 | Hayashida | 220/374 |

*Primary Examiner*—George T. Hall

*Attorney, Agent, or Firm*—Leydig, Voit, Osann, Mayer & Holt, Ltd.

[57] ABSTRACT

A cap for accommodating an overflow of brake fluid from a master cylinder reservoir and for venting the reservoir to atmosphere. The cap is formed from two cup-shaped members adapted to be telescoped together with a snap fit and adapted, when telescoped together, to define an overflow chamber and to define a labyrinth-like passage for venting the chamber to atmosphere.

14 Claims, 5 Drawing Figures

OVERFLOW AND VENT CAP FOR A CONTAINER

BACKGROUND OF THE INVENTION

This invention relates generally to a removable cap for closing a container of liquid while venting the container to atmosphere in order to allow air to escape from the container.

More specifically, the invention relates to a cap for closing the reservoir of the master cylinder of a surge brake actuator of the type disclosed, for example, in Huetsch et al. U.S. Pat. No. 4,223,766. Such an actuator is mounted on the tongue of a trailer and operates the master cylinder to apply the trailer brakes automatically when the trailer surges forwardly and tends to overrun the towing vehicle. In some cases, brake fluid in the reservoir of the master cylinder overflows into the cap and, to enable the cap to receive the fluid, it is necessary that the cap be vented to atmosphere by means of a passage in the cap. Being carried on the tongue of the trailer, the cap is subjected to dirt, grease, water and other foreign material which tends to plug the vent passage and/or enter into the reservoir by way of the vent passage.

SUMMARY OF THE INVENTION

The general aim of the present invention is to provide an extremely inexpensive and easy-to-make event and overflow cap which is uniquely constructed to keep the vent passage substantially free of foreign material and to prevent such material from entering the reservoir through the vent passage.

A more detailed object of the invention is to achieve the foregoing by providing a cap having two cup-shaped members, preferably molded from low-cost plastic, adapted to snap together and adapted when snapped together to define an overflow chamber and to define a labyrinth-like passage which leads from the chamber to atmosphere.

A further object is to provide a cap of the foregoing type in which a venting path is established around the circumference of the cap and in which an effective venting path is maintained even if part of the labyrinth-like passage should become plugged with foreign material.

The invention also resides in the unique manner of constructing the cup-shaped members to enable economical formation of the labyrinth-like vent passage and to enable quick and easy assembly of the members.

These and other objects and advantages of the invention will become more apparent from the following detailed description when taken in conjunction with the accompanying drawings.

DETAILED DESCRIPTION OF THE PREFERRED EMBODIMENT

Figure 1:
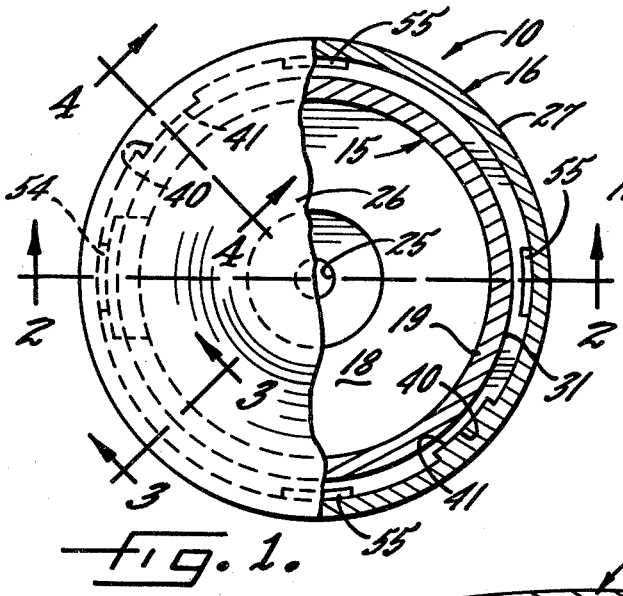
FIG. 1 is a top plan view of a new and improved vent cap incorporating the unique features of the present invention, part of the cap being broken away and shown in section.

As shown in the drawings for purposes of illustration, the invention is embodied in a removable cap 10 for closing a container 11 of liquid while venting the container to atmosphere. Although the cap may be used to close various types of containers, it is particularly well-suited for use in conjunction with a container which forms the reservoir of the master cylinder of a hydraulic braking system. One type of hydraulic braking system is disclosed in the aforementioned Huetsch et al. patent and includes a surge brake actuator mounted on the tongue of a trailer and having a master cylinder with a reservoir which contains brake fluid. When the trailer surges forwardly relative to the towing vehicle, the master cylinder forces brake fluid from the reservoir to the trailer wheel cylinders to apply the trailer brakes. The brake fluid returns to the reservoir when the brakes are released.

The container 11 which has been illustrated is a master cylinder reservoir having a top wall 12. An opening 14 which herein is internally threaded, is formed through the top wall and normally is closed by the cap 10. When the cap is removed, brake fluid may be poured into the opening to fill the reservoir 11.

When brake fluid returns rapidly to the reservoir 11 or when the brake fluid thermally expands in a full reservoir, the fluid may overflow through the opening 25 and into the cap 10. Accordingly, the cap must be capable of accommodating the overflow fluid and, in order to enable fluid to flow to the reservoir and to the cap, it is necessary that the reservoir be vented to atmosphere via the cap. Since the reservoir is located on the trailer tongue, the cap is exposed to dirt, grease, water and other contaminants which must be prevented from entering the reservoir by way of the vent path through the cap and which tend to clog the vent path and prevent proper venting of the cap and the reservoir.

According to the present invention, provision is made of a unique vent and overflow cap 10 which is characterized particularly by its comparatively simple and inexpensive two-piece construction and which is further characterized by a labyrinth-like vent path. The vent path is defined and established when the pieces of the cap are assembled with one another and, because of its labyrinth-like shape, the vent path restricts the entry of foreign material into the cap and reservoir 11.

Figure 2:
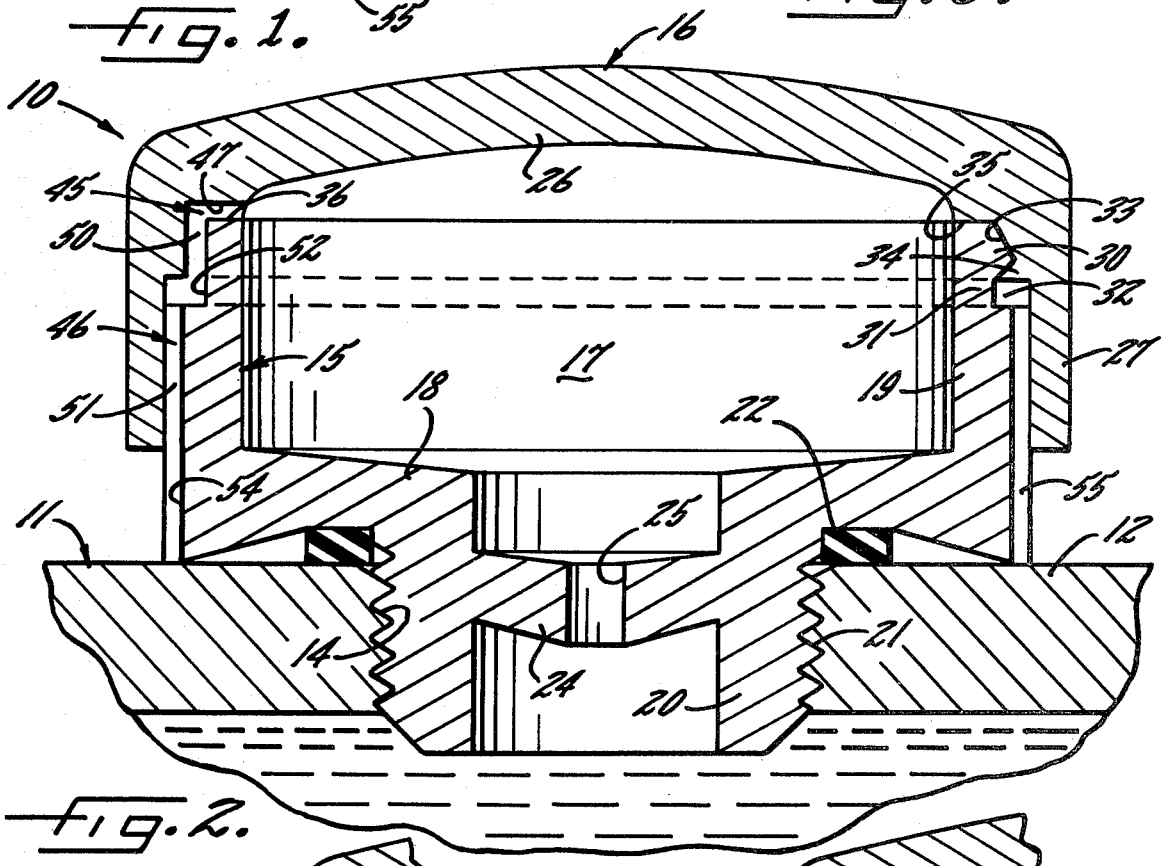
FIG. 2 is an enlarged fragmentary cross-section taken substantially along the line 2—2 of FIG. 1 and shows the cap attached to a typical container.

In carrying out the invention, the vent cap 10 is formed by a lower, upwardly opening cup-shaped piece or member 15 (FIG. 2) and by an upper, downwardly opening cup shaped piece or member 16. Both members 15 and 16 preferably are molded from a relatively hard plastic (e.g., polypropylene) and are adapted to be assembled to one another with a snap fit. When assembled, the members coact to define an overflow chamber 17 for brake fluid and further coact to define a labyrinth-like vent path which leads from the chamber to atmosphere.

More specifically, the lower cup-shaped member 15 includes a generally horizontal circular bottom wall 18 (FIG. 2) and a cylindrical side wall 19 upstanding from the peripheral margins of the bottom wall. Formed integrally with and depending from the bottom wall 18 is a coupling means in the form of a tubular protrusion or plug 20 which herein is formed with external threads 21 and which is adapted to be screwed into the opening 14 in the reservoir 11. A rubber gasket 22 encircles the plug and is adapted to be compressed between the bottom wall 18 of the cup 15 and the top wall 12 of the reservoir 11 to prevent brake fluid from leaking around the threads.

Spanning the interior of the plug 20 is a web 24 (FIG. 2) which is formed with a vertical hole 25 of relatively small diameter. The hole establishes communication between the reservoir 11 and the chamber 17 and permits brake fluid to overflow into the chamber. The upper side of the web is shaped as a downwardly tapered frustum to facilitate the draining of brake fluid back into the reservoir.

The upper cup 16 includes a generally circular top wall 26 (FIG. 2) and further includes a side wall or skirt 27 which depends from the peripheral margins of the top wall. In this particular instance, the skirt 27 of the upper cup 16 is adapted to telescope over the side wall 19 of the lower cup 15 and, when the two cups are telescoped together, the overflow chamber 17 is defined by the space enclosed by the bottom and side walls 18 and 19 of the lower cup and by the top wall 26 of the upper cup.

Figure 5:
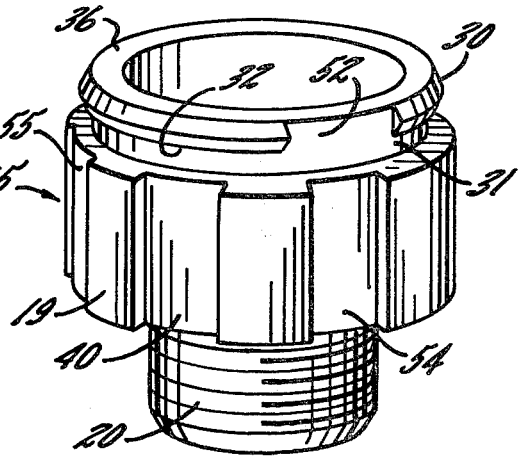
FIG. 5 is a perspective view of one of the cup-shaped members of the cap.
Figure 3:
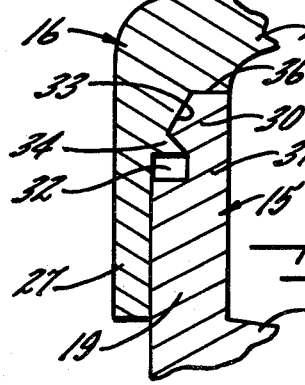
FIGS. 3 and 4 are enlarged fragmentary cross-sections taken substantially along the lines 3—3 and 4—4, respectively, of FIG. 1.

Pursuant to the invention, the two cups 15 and 16 are adapted to be locked against axial separation and relative rotation as an incident to being telescoped together and, in addition, the vent path is established when the cups are assembled. To prevent axial separation of the cups, an outwardly projecting frustoconical rib 30 (FIGS. 2, 3 and 5) is formed around the upper end portion of a short, reduced diameter neck 31 which projects upwardly from the upper end of the side wall 19 of the lower cup 15. As a result of the neck 31, a groove 32 is defined between the lower side of the rib 30 and the upper end of the side wall 19 and extends circumferentially around the lower cup 15.

A circumferentially extending groove 33 (FIG. 2) which is complementary in shape to the rib 30 is formed around the inside of the skirt 27 of the upper cup 16. The lower side of the groove 33 is defined by an inwardly projecting fin 34 while the upper side of the groove is located adjacent a downwardly facing annular surface 35 which extends around the top wall 26 of the upper cup 16. When the two cups 15 and 16 are telescoped together, the fin 34 of the groove 33 engages the cams past the upper side of the rib 30 and then snaps inwardly beneath the rib and locks against the lower side of the rib as the rib enters the groove. Such locking, together with the seating of the rib 30 in the groove 33, prevents the cups from being separated axially. In the finally assembled position of the cups, the downwardly facing annular surface 35 of the upper cup 16 seats face-to-face with an upwardly facing annular surface 36 which defines the lip of the lower cup 15.

Figure 4:
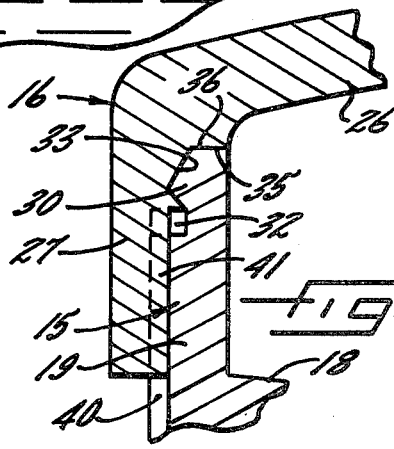

To prevent relative rotation of the cups 15 and 16, two diametrically spaced and axially extending notches 40 (FIGS. 1, 4 and 5) are formed in the outer surface of the side wall 19 of the lower cup 15. Two diametrically spaced and axially extending ribs or keys 41 project inwardly from the skirt 27 of the upper cup 16. When the cups are telescoped together, the keys 41 enter the notches 40 and prevent the cups from rotating relative to one another.

The labyrinth-like vent path is defined between the two cups 15 and 16 and includes a radially extending passage 45 (FIG. 2) and an axially extending passage 46. The radially extending passage 45 advantageously is formed by molding a radially extending and downwardly opening notch 47 (FIGS. 1 and 2) in a short (e.g., 35 degrees) circumferential section of the downwardly facing annular surface 35 of the top cup 16. As a result of the notch 47, the interrupted section of the annular surface 35 does not engage the lip 36 of the lower cup 15 and thus a radial passage 45 leading from the chamber 17 is defined above a short circumferential section of the lip (see FIG. 2).

The axially extending passage 46 is defined by upper and lower sections 50 and 51. The upper section 50 of the axially extending passage 46 communicates at its upper end with the radially extending passage 45 and is formed in part by molding an axially extending notch 52 (FIG. 5) in the rib 30 throughout the height thereof. The notch 52 is alined angularly with the notch 47 and has the same angular length as the notch 47. In addition to forming the notch 52 in the rib 30, a short and angularly alined section of the groove 33 in the upper cup 16 is effectively widened by making the outer side wall of the groove straight rather than V-shaped. The notch 52 and the widened section of the groove 33 thus coact to define an axially extending passage section 50 located between the two cups and communicating with the radially extending passage 45.

The lower section 51 of the axially extending passage 46 is defined by molding an axially extending notch 54 (FIGS. 2 and 5) in the outer surface of the side wall 19 of the lower cup 15. The notch 54 is alined angularly with the notch 52 in the rib 30 (see FIG. 5) and communicates with the latter notch via the groove 32.

From the foregoing, it will be apparent that the axially extending passage sections 50 and 51 coact with the radially extending passage 45 to define a tortuous or labyrinth-like vent path between the chamber 17 and atmosphere. Because of the shape and orientation of the path, dirt and water are restricted from entering the chamber 17 and thus the reservoir 11 is less likely to be contaminated. Since the passages 45 and 46 are defined between the two cups 15 and 16, there is no need to use retractable core pins to form passages through the cups themselves and thus molding of the cups is simplified. The cap 10 formed by the two telescoped cups can be formed in an extremely economical manner and is very inexpensive.

Preferably, additional (herein, three) axially extending notches 55 (FIGS. 1 and 5) are formed in and are spaced around the outer surface of the side wall 19 of the lower cup 15. The notches 55 communicate with the axial passage section 50 and the radial passage 45 by means of the groove 32 and provide venting paths around the circumference of the cap 10. In the event that the notch 54 should become plugged with dirt or the like, a vent path for the chamber 17 is maintained via the notches 55. Any dirt entering one of the notches 55, however, must travel around the groove 32, into the passage section 50 and through the radial passage 45 before such dirt can enter the chamber 17.

In the appended claims, the terms "upper" and "lower" and other terms indicative of vertical orientation have been used merely for purposes of simplicity and clarity. It will be appreciated that the cap 10 need not necessarily be oriented with the plug 20 extending downwardly but instead can be oriented in any manner dictated by the container with which the cap is used.

I claim:

1. A cap for closing an opening in the top of a container for liquid while venting the container to atmosphere, said cap comprising a lower, upwardly opening cup-shaped member, coupling means on the bottom of said cup-shaped member and adapted to interfit releasably with the opening in the container, a hole in said cup-shaped member and establishing communication between the container and the interior of said cup-shaped member, an upper, downwardly opening cup-shaped member telescoped with said lower cup-shaped member whereby a chamber is defined between the two members, means on said members and preventing axial separation and relative rotation of the members, a radially extending vent passage defined between said members and communicating with said chamber, and an axially extending vent passage defined between said members and communicating with said radially extending vent passage, the axially extending vent passage being open to atmosphere.

2. A cap as defined in claim 1 in which said coupling means comprises a tubular protrusion formed integrally with and depending from the bottom of said lower cup-shaped member.

3. A cap as defined in claim 2 further including a web formed integrally with said protrusion and extending across the interior thereof, said hole being formed in and extending through said web.

4. A cap as defined in claim 2 further including screw threads formed around said protrusion.

5. A cap as defined in claim 1 in which the lip of said lower cup-shaped member engages a downwardly facing annular surface formed integrally with and extending around the top of said upper cup-shaped member, said radially extending vent passage being defined by a radially extending notch formed in one of said lip and said surface.

6. A cap as defined in claim 5 in which said notch is formed in said downwardly facing surface and opens downwardly.

7. A cap as defined in claim 5 in which said means for preventing axial separation of said members comprise a groove extending circumferentially around one of said members, and a radially extending rib extending circumferentially around the other of said members and snapped into said groove.

8. A cap as defined in claim 7 in which a first axially extending notch is formed through said rib and defines an upper part of said axially extending passage.

9. A cap as defined in claim 8 in which said first axially extending notch is alined angularly with said radially extending notch and communicates therewith.

10. A cap as defined in either of claims 8 or 9 in which a lower part of said axially extending passage is defined by an axially extending and upwardly opening notch formed in the outer side of said lower cup-shaped member and communicating with said first axially extending notch.

11. A cap as defined in either of claims 8 or 9 in which axially extending and upwardly opening notches are formed in and are spaced circumferentially around the outer side of said lower cup-shaped member, and a groove formed in and extending circumferentially around the outer side of said lower cup-shaped member and located between the upper ends of the latter notches and the lower end of said first axially extending notch to establish communication therebetween.

12. A cap as defined in claim 1 in which said means for preventing relative rotation of said members comprise an axially extending key on one of said members and fitting snugly into an axially extending notch formed in the other of said members.

13. A cap as defined in claim 12 in which the latter notch is formed in the outer side of said lower cup-shaped member, said key being formed on the inner side of said upper cup-shaped member.

14. A cap for closing an opening in the top of a container for liquid while venting the container to atmosphere, said cap comprising a lower, upwardly opening cup-shaped member, coupling means on the bottom of said cup-shaped member and adapted to interfit releasably with the opening in the container, a hole in said cup-shaped member and establishing communication between the container and the interior of said cup-shaped member, an upper, downwardly opening cup-shaped member telescoped with said lower cup-shaped member whereby a chamber is defined between the two members, said members having vertically facing surfaces disposed in face-to-face engagement, a notch formed in one of said surfaces and defining a radially extending passage leading from said chamber, a circumferentially extending groove formed in one of said members, a circumferentially extending rib formed on the other of said members and projecting radially into said groove to prevent axial separation of said members, and an axially extending notch formed through said rib and defining an axially extending passage having an upper end communicating with said radially extending passage and having a lower end open to atmosphere.

* * * * *